US008920191B2

(12) United States Patent
Carpanzano

(10) Patent No.: US 8,920,191 B2
(45) Date of Patent: Dec. 30, 2014

(54) CLAMP-ON FURNITURE ELECTRICAL OUTLET

(71) Applicant: Edison Nation, LLC, Charlotte, NC (US)

(72) Inventor: Michael C. Carpanzano, New Milford, CT (US)

(73) Assignee: Edison Nation, LLC, Charlotte, NC (US)

( * ) Notice: Subject to any disclaimer, the term of this patent is extended or adjusted under 35 U.S.C. 154(b) by 176 days.

(21) Appl. No.: 13/738,970

(22) Filed: Jan. 10, 2013

(65) Prior Publication Data

US 2014/0030910 A1 Jan. 30, 2014

Related U.S. Application Data

(60) Provisional application No. 61/585,166, filed on Jan. 10, 2012.

(51) Int. Cl.

| | |
|---|---|
| ***H01R 25/00*** | (2006.01) |
| ***H01R 13/74*** | (2006.01) |
| ***H01R 43/26*** | (2006.01) |
| ***H01R 13/72*** | (2006.01) |

(52) U.S. Cl.

CPC ..... *H01R 13/74* (2013.01); *H01R 43/26* (2013.01); *H01R 13/72* (2013.01); *H01R 25/006* (2013.01)

USPC ..... 439/574; 439/491

(58) Field of Classification Search

USPC ..... 439/574, 575, 491

See application file for complete search history.

(56) References Cited

U.S. PATENT DOCUMENTS

| | | | | |
|---|---|---|---|---|
| 4,146,281 | A | 3/1979 | Quartarone | |
| 5,057,039 | A * | 10/1991 | Persing et al. | 439/574 |
| 6,004,157 | A * | 12/1999 | Glass | 439/574 |
| 6,379,182 | B1 * | 4/2002 | Byrne | 439/574 |
| 6,540,554 | B2 * | 4/2003 | McCarthy | 439/574 |
| 6,568,335 | B2 | 5/2003 | Hamilton et al. | |
| 7,083,421 | B1 * | 8/2006 | Mori | 439/574 |
| 7,736,178 | B2 * | 6/2010 | Byrne | 439/574 |
| 7,938,679 | B2 * | 5/2011 | Wadsworth et al. | 439/574 |
| 2002/0168894 | A1 * | 11/2002 | Goebel | 439/574 |
| 2003/0034167 | A1 | 2/2003 | DeLand | |
| 2005/0003700 | A1 * | 1/2005 | Huang | 439/491 |
| 2005/0186836 | A1 * | 8/2005 | Hsu et al. | 439/491 |
| 2013/0280956 | A1 * | 10/2013 | Cheng et al. | 439/620.15 |

* cited by examiner

*Primary Examiner* — Gary Paumen

(74) *Attorney, Agent, or Firm* — Tillman Wright, PLLC; James D. Wright; David R. Higgins

(57) ABSTRACT

A mobile outlet apparatus and process for providing electrical current by means of a clamp-on outlet extender attached to an object and connected to a stationary source of electric current is provided. A description of several possible clamping systems for attaching the mobile outlet to an object is provided, as well as a description of different voltage conversion and outlet options on the mobile outlet. In one configuration the mobile outlet is particularly designed to provide a flat profile and to allow quick attachment and detachment by means of a ratchet system. The mobile outlet is also designed to allow attachment of various faceplates for purposes of decor matching and branding purposes.

23 Claims, 7 Drawing Sheets

FIG. 1
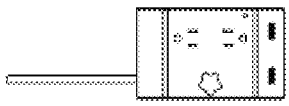
FIG. 1A
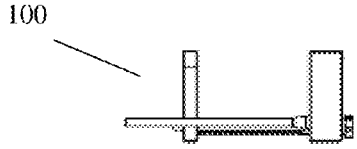
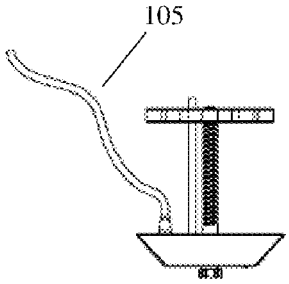
FIG. 1B
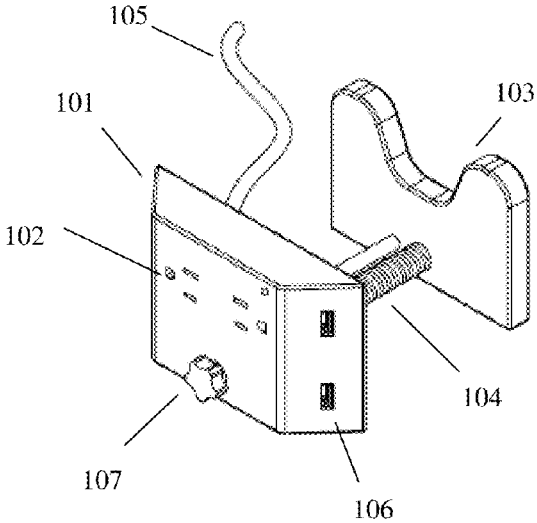
FIG. 1C

CLAMP-ON FURNITURE ELECTRICAL OUTLET

CROSS REFERENCE TO RELATED APPLICATIONS

This application is a U.S. Utility application taking priority from U.S. Provisional application No. 61/585,166 filed Jan. 10, 2012, and herein incorporated by reference.

BACKGROUND OF THE INVENTION

References

U.S. Pat. No. 6,568,335 B2, John R. Hamilton et. al., Furniture Accessory Supporting System US Application #2003/0034167, Martin LeLand, Adjustable Power and Telecommunications Outlet Apparatus and Method for Furniture and Wall Structures U.S. Pat. No. 4,146,281, Carmelo Quartarone, Articulated Electrical Extension Device U.S. Pat. No. 7,083,421, Kenneth Mori, Electrical Connectivity System Capable of Being Mounted to an Object, and Method of Manufacturing Same The invention described herein relates generally to a method of bringing electrical power or signals from a wall to the front or side of an object which may be blocking the power or signal outlet on the wall. In a household or office environment, bulky furniture such as couches, filing cabinets, bookcases, beds, and desks may block outlets such as those for electrical power, coaxial cable, communications cable such as but not limited to Cat 5 cable and phone jacks. In a warehouse crates may block outlets, while on a construction site large pieces of equipment or construction supplies may block an outlet. It may also merely be more convenient to have an outlet in a different location then it may be provided. In providing a solution to this problem, it would be advantageous, to have a "universally" flexible outlet, which could be attached to any object in any environment to allow the user to plug into said outlet. It would further be advantageous to allow mounting of this outlet on any position on said object, along a front, a side, a leg, and so on. This invention provides these advantages.

SUMMARY DISCLOSURE OF INVENTION

The present invention solves these and other problems as described below. The invention described herein relates generally to a method of bringing electrical power or signals from a wall, floor, or other existing source of electrical power or signals to the front or side of an object such as, but not limited to, a piece of furniture which may be blocking the power or signal outlet on the wall, thereby extending the outlet to a more useful position. Even if an outlet is not blocked, having a mobile outlet which can be attached to a wide variety of objects may be useful to bring electrical power or signals to a more convenient location, such as a more convenient height. More particularly, an extension wire is plugged into the power or signal receptacle on the wall, and the wire is used to convey the electrical power or signal to a receptacle which is clamped removably to the object. In a preferred embodiment, the clamping system will be designed so as to not damage said object, particularly in the case of furniture.

One embodiment of this invention provides electrical outlets on the furniture. Another embodiment of this invention provides signal outlets, such as coaxial cable, computer signal cable such as but not limited to Cat 5 cable, telephone outlets, or USB outlets. USB outlets can be considered either signal or power, as some devices such as wireless gaming controllers, phones, electronic readers and tablets are designed to be powered from a USB outlet. Obviously these outlets can be combined, with, for example, electrical outlets and USB outlets on the same outlet.

BRIEF DESCRIPTION OF DRAWINGS

FIG. 1 shows a front, a side (FIG. 1A), a top (FIG. 1B), and a perspective (FIG. 1C) view of one embodiment of the outlet extending system, comprising a plug, extender cord and clamping system to attach the outlet to furniture.

MODE(S) FOR CARRYING OUT THE INVENTION—DETAILED DESCRIPTION

Figure 2:
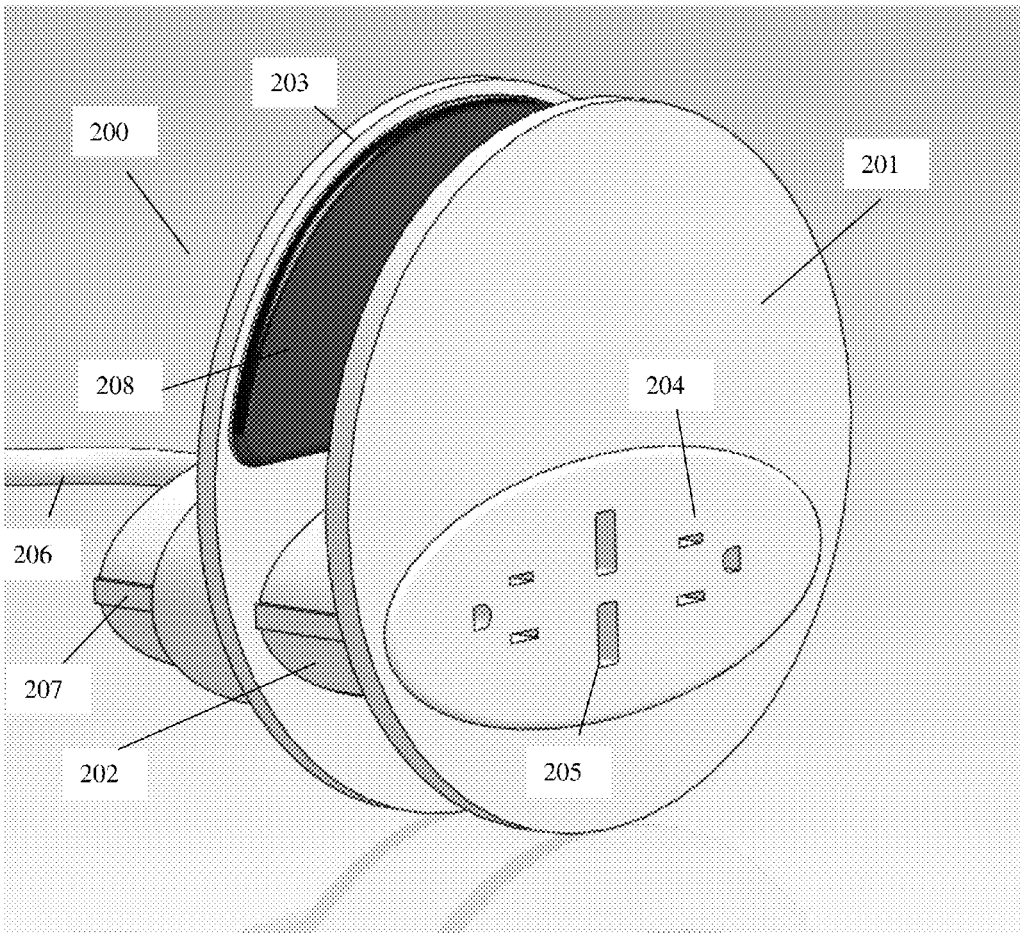
FIG. 2 shows another embodiment of the outlet extending system.

The present invention and its various embodiments are described below, with reference to figures as necessary. Reference numbers are used to match particular elements described in the text with those shown in figures. Although the embodiments disclosed will be described with reference to the embodiments shown in the drawings, it should be understood that the embodiments disclosed can be embodied in many alternate forms of embodiments. In addition, any suitable size, shape or type of elements or materials could be used.

Generally speaking, the present invention describes an apparatus and associated methods of construction for an outlet provider or extender system, thereby providing a mobile outlet which can be attached to an object in a convenient place. The outlet extender 100 has a front plate 101 having one or more electrical outlets 102 which are capable of receiving a plug to provide electrical current, and a back plate 103, each of which plates has flat surfaces which face each other. Note that while reference is made in this disclosure to "front" and "back" plates or faces, these two plates could be on the sides of an object to which they are clamped, thereby facing left and right, or in an orientation whereby they face up and down and so on. Similarly, more than two plates could be used such that they may be on several sides of the object to which they are clamped. While these surfaces are shown and described as generally flat, one or both could also be slightly or substantially concave, to more effectively clamp onto curved surfaces such as table legs, or convex to provide a better gripping surface. The outlet extender 100 also has a connection between the face plate and the back plate 104 which has some means to bring the front plate 101 and back plate 103 together with the flat surfaces facing each other. Finally, it has a wire or cable 105 leading to a plug (not shown) which plugs into a stationary source of electrical current such as a wall outlet. This outlet can be for electrical power, such as but not limited to, 12 VDC such as in a marine or RV environment, 110V AC or 220V AC.

Alternatively, it can be for electrical signals such as coaxial cable or Cat 5 cable, or for optical signals such as those carried by optical fiber. An appropriate plug and cable 105 would be used depending on the type of power or signal. Preferably, since this system is designed to be used where a piece of furniture is close to a wall, the plug would have a flat profile, so when plugged in it does not protrude far from the wall. This can be accomplished with a variety of plugs known to those in the art such as, but not limited to, right angle plugs, flat plugs, and so on. Preferably, the cable 105 would have a flat profile to allow for more convenient storage and wrapping around the outlet extender if necessary.

In one embodiment of this invention, the outlet box face 101 could have multiple types of outlets on it, such as, but not limited to, standard U.S. 110-120 VAC power 102 and USB power 106. Note that the AC outlets are opposed to each other, making it easier to plug in transformers, while this is a convenient feature it is clear that outlets could be oriented in any direction relative to each other, even being rotatable, and could be present in any number, providing at least one is present. Also, although a typical outlet for United States power plugs is shown, clearly this outlet extender could be made with a variety of international outlet styles, potentially even having a mix of types. This outlet box could have a small converter circuit inside it of a type known to those in the art to convert wall socket AC power to USB power such that a USB powered device could be plugged into outlet box face 101 at USB outlet 106. Other types of power conversion could be carried out including, but not limited to, AC to DC conversion, DC to AC conversion or conversion between different AC voltages, such as for international usage. This outlet box could also have a surge suppressor in it, to condition the power from the stationary source in order to prevent damage to electrical devices plugged into the outlets. In an alternative embodiment, instead of a conversion or conditioning unit in the outlet box, a conversion or conditioning unit could be built into the plug system or placed along the length of the cord. Conditioning units such as surge suppressors can be employed for any power or signal source delivered by the outlet extender, such as, but not limited to, AC voltage, phone lines, and so on. Other features such as on/off switches and status lights could clearly be included.

In one embodiment of this outlet extender back plate 103 is employed with a tightening knob 107 and a threaded spindle 104 or screw to bring together the face plate 101 and the back plate 103. Together these systems form a "C" cross section, as is known in a "C clamp" for clamping things together, for example when gluing two items together and holding them in place for the glue to dry. This would allow the user to clamp the outlet to a piece of furniture or other object. In a particular embodiment, one or both facing surfaces of said outlet face plate 101 and said back plate 103 would be constructed such as to avoid damage to the furniture. This could be by means such as, but not limited to, using padding type material on said surfaces, which may include attaching soft plastic on said surfaces, attaching open or closed cell foam on said surfaces, adding textured silicone or constructing said surfaces or outlet extender primarily out of plastic. Said padding type materials could be removable or interchangeable for use with different types of furniture. Different types of tightening knobs 107 could be used, as known in the art, such as, but not limited to, a hex nut for use with a wrench, or a sliding bar such as used in a bench vise, or a "butterfly" nut which can easily be tightened with the fingers. In one particular embodiment a "fold-down" butterfly nut would be advantageous for this tightening knob, so that it would be easy to manipulate but when not being tightened it could be folded down so that it maintains a flat profile. In another particular embodiment hex nuts or other types of nuts which depress into the recess on the surface of the outlet extender could be used. Although the facing surfaces of the front plate 101 and back plate 103 are shown as flat, one or both could also be slightly or substantially concave, to more effectively clamp onto curved surfaces such as table legs, or convex to provide a better gripping surface.

Different lengths of threaded spindles 104 could be supplied to allow clamping of the assembly to different types or portions of furniture, such as a narrow piece of couch frame or a wide padded arm of a couch. This screw type clamping system embodiment has the advantage of very secure fastening to objects, which may be helpful in an environment such as warehouses or construction sites where heavy devices may be frequently plugged and unplugged. Alternatively, in place of a threaded spindle, a spring clamp could be used, such as are known in the art from clamp-on lights, which would hold the outlet box in place via tension from the spring. Other types of fastening systems would suggest themselves to one skilled in the art, and are intended to be covered in this disclosure.

In another embodiment of this outlet extender 200 shown in FIG. 2 the profile of the face plate 201 is greatly reduced by placing the bulky electrical portion of the outlet in the connector system 202 between the face plate 201 and the back plate 203. In a normal outlet such as 102 in FIG. 1 substantial depth is needed for the male prongs of an AC plug to go into the outlet 102 or for a male USB connector to go into a female socket 106, in addition to any depth needed for power processing features. This would cause the face plate 101 of an outlet extender to protrude substantially from the surface of the furniture or other object to which it is attached. The additional space allowed for electrical components by putting them in the connector system 202 allows for use of cheaper, easier to assemble components. It is advantageous to have a nearly flush mounted face plate 201 to avoid tripping, blocking of a walkway and for improved attractiveness in a furnished interior of a dwelling. In this way outlets such as, but not limited to, the AC outlets 204 and USB outlets 205 are nearly flush with the object the outlet extender 200 is clamped to. Note that the AC outlets are opposed to each other, making it easier to plug in transformers, while this is a convenient feature it is clear that outlets could be oriented in any direction relative to each other, even being rotatable, and could be present in any number, providing at least one is present. Also, although a typical outlet for United States power plugs is shown, clearly this outlet extender could be made with a variety of international outlet styles, potentially even having a mix of types. As with other embodiments various types of power conversion could be carried out by circuits in the core or connecter system 202 of the outlet extender 200 including, but not limited to, AC to DC conversion or conversion between different AC voltages, such as for international usage. This core of the extender 202 could also have a surge suppressor in it, to condition the power from the stationary source in order to prevent damage to electrical devices plugged into the outlets. The core of the extender 202 could also have one or more retractable cords inside, allowing storage of a charging cord for a device or storage of the cord leading to the stationary power outlet or both. In one embodiment, the wire or cable 206 would have a flat profile to allow for more convenient storage and wrapping around the core 202 for compact storage of the outlet extender, although clearly wrapping the cable 206 around the core 202 for storage is not dependent on a flat profile of the cable 206. In an alternative embodiment of the outlet extender 200, instead of a conversion or conditioning unit in the core of the extender 202, a conversion or conditioning unit could be built into the plug system or placed along the length of the cord. Conditioning units such as surge suppressors can be employed for any power or signal source delivered by the outlet extender, such as, but not limited to, AC voltage, phone lines, and so on. Other features like rotatable outlets, child-proof safety caps, and on/off switches could be included. This design also helps to prevent torque from unplugging power cords from causing the outlet extender to fall off the object it is attached to. The wire or cable 206 carrying power or signal to the outlet extender 200 is behind or underneath the object to which the outlet extender is clamped, keeping it out of the way.

In one embodiment of this outlet extender 200 the back plate 203 may slide back and forth on the connector system 202 by means of one or more rails 207. In a further embodiment of this outlet extender 200 there may be padding type material 208 on the facing surfaces of the face plate 201 and the back plate 203. This helps to protect whatever object the outlet extender may be fastened to. This use of padding type material 208 may include attaching soft plastic on said surfaces, attaching open or closed cell foam on said surfaces, adding textured silicone or constructing said surfaces or outlet extender primarily out of plastic. Said padding type materials could be removable or interchangeable for use with different types of furniture.

In another advantage of this outlet extender 200 it allows the face plate 201 to be the only part visible in the outlet extender 200, so by means of detachable and interchangeable face plates different designs having a variety of colors, shapes and patterns can be used which may match interior decor of the furniture or decor of a device which may be plugged into them. These designs may incorporate features of the outlets into their design, forming shapes such as, but not limited to, noses, lips, eyes, and so on. The plates may be formed in shapes such as a rectangle which might be used to portray a can, a football, a cartoon character and so on. These shapes, colors and patterns could be tailored to a variety of branding purposes.

Figure 3:
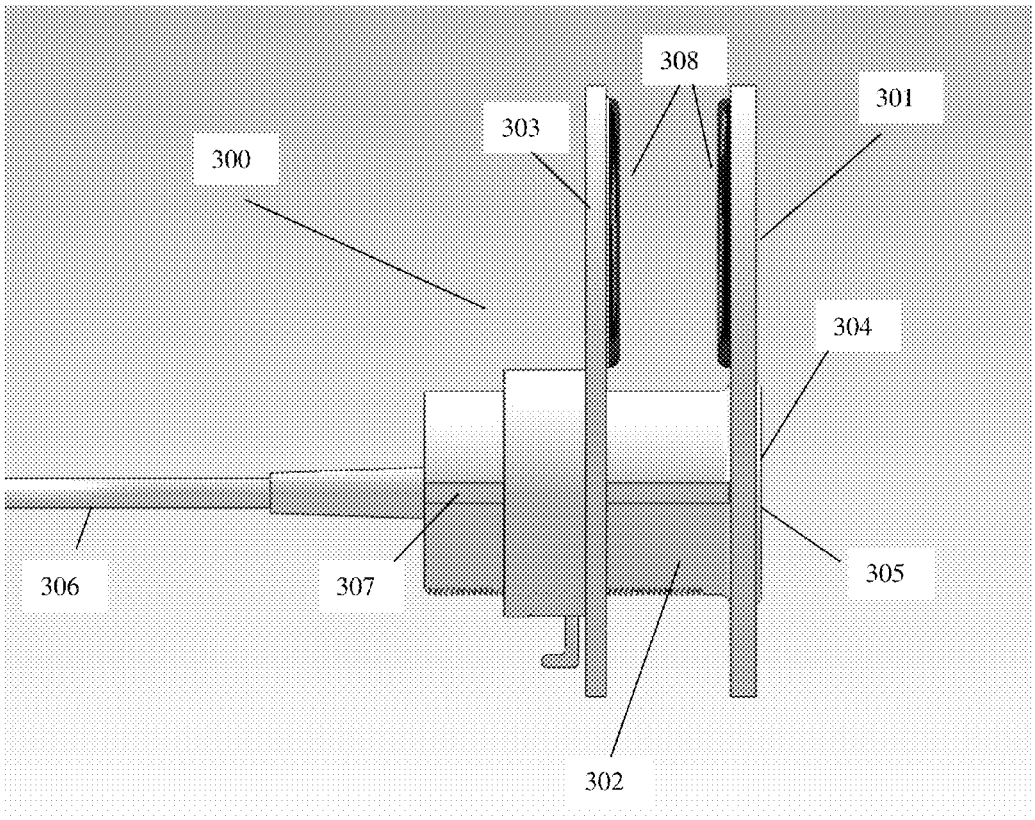
FIG. 3 shows the second embodiment of the outlet extending system in cross section.

FIG. 3 shows a side view of the outlet extender 300. Visible are the front face plate 301, the connector system 302, and the back plate 303. It can be seen that outlets such as AC 304 and USB 305 outlets are nearly flush with the face plate 301. A wire 306 connects to the electrical system inside the connector 302. This system may be merely a pass-through of AC power or other signals such as coaxial cable, CAT 5 cable, or a telephone wire, or include features such as, but not limited to, a surge suppressor, and a converter circuit from AC to USB power. The system comprising the back plate 303 slides back and forth on rails 307, and in an exemplary embodiment padding 308 is shown on both front face plate 301 and back plate 303. The serrated edge 309 on the connector system 302 and the latch 310 to latch the front plate 301 and back plate 303 in place are discussed in more detail in FIG. 5. Although the facing surfaces of the front plate 301 and back plate 303 are shown as flat, one or both could also be slightly or substantially concave, to more effectively clamp onto curved surfaces such as table legs, or convex to provide a better gripping surface.

Figure 4:
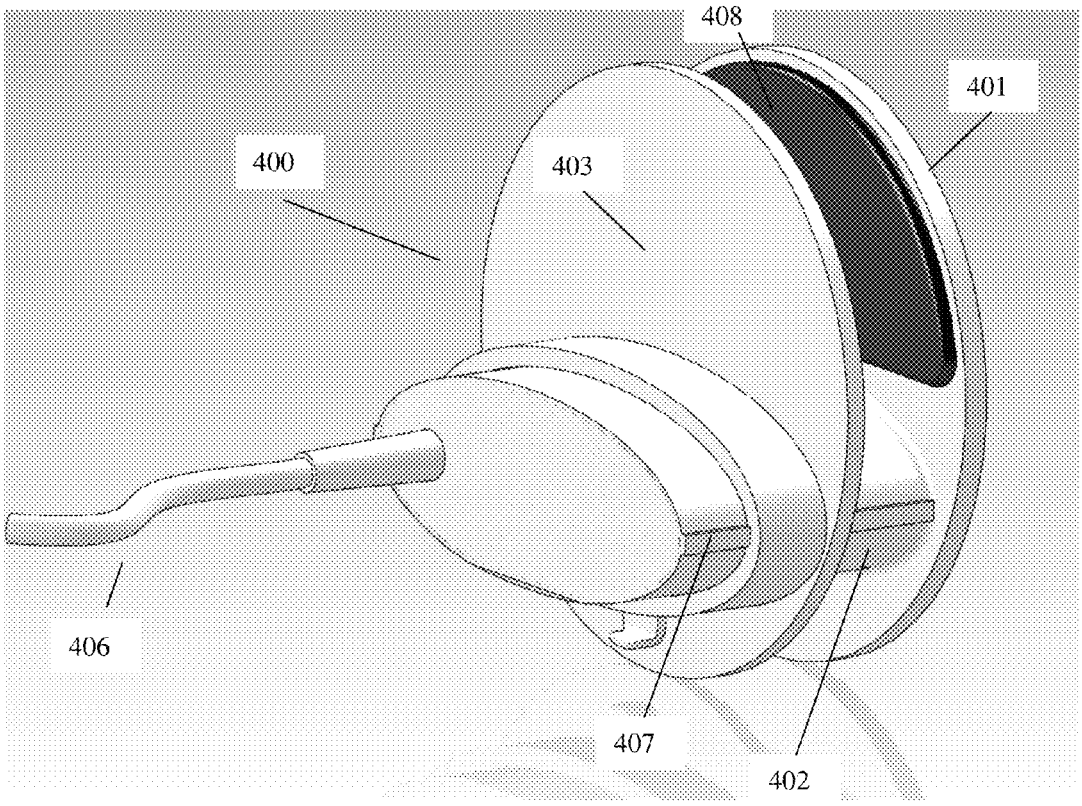
FIG. 4 shows the second embodiment of the outlet extending system from another angle.

In FIG. 4 this embodiment of the outlet extender 400 is shown from a partial rear view. The face plate 401, connector 402, back plate 403, cord 406, rail 407 and padding 408 are as discussed in FIGS. 2 and 3.

Figure 5:
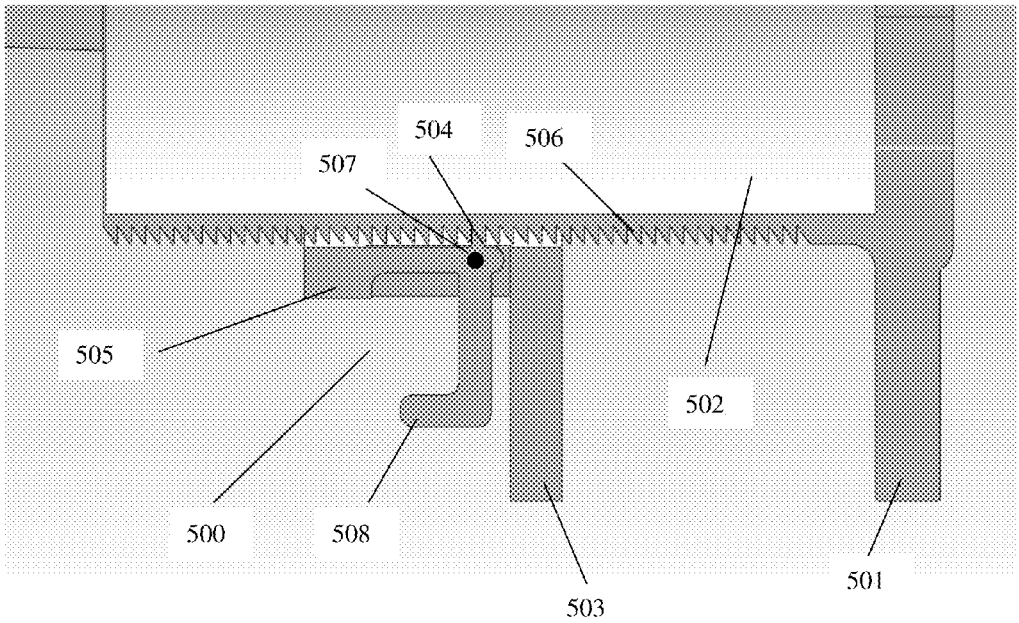
FIG. 5 shows details of a ratchet system for clamping said outlet extending system to an object.

FIG. 5 shows an exemplary latch 500 for the outlet extender 300, with a magnified portion of the lower cross section from FIG. 3. Front plate 501 is connected using connector section 502 to back plate 503. Back plate 503 can be readily moved towards front plate 501 because the protrusion 504 on lever arm 505 is slanted to pass readily along the slanted serrations 506 on connector section 502, with the lever arm 505 pivoting around pivot point 507 to allow protrusion 504 to pass over each serration in sequence. Once the back plate 503 has been moved to clamp onto an object between it and front plate 501, the protrusion 504 locks into place on the serrations because of aforementioned slanting of the faces of said protrusion and said serrations 506. In order to release the back plate, lever arm or latch 505 can be pressed at location 508, allowing lever arm 505 to pivot around pivot point 507, disengaging protrusion 504 from serrations 506, and allowing back plate 503 to slide freely along the connector section 502 along, for example, rails (shown as 307 in FIG. 3). This ratchet system has the convenience of offering a fast way to clamp the outlet extender 300 onto an object in a way similar to a zip tie and to release it, in particular without needing to see the release latch 508, which may be under a piece of furniture. The release latch can merely be squeezed, trigger-style, at location 508. This embodiment has advantages of one handed operation, few moving parts and simple assembly.

Figure 6:
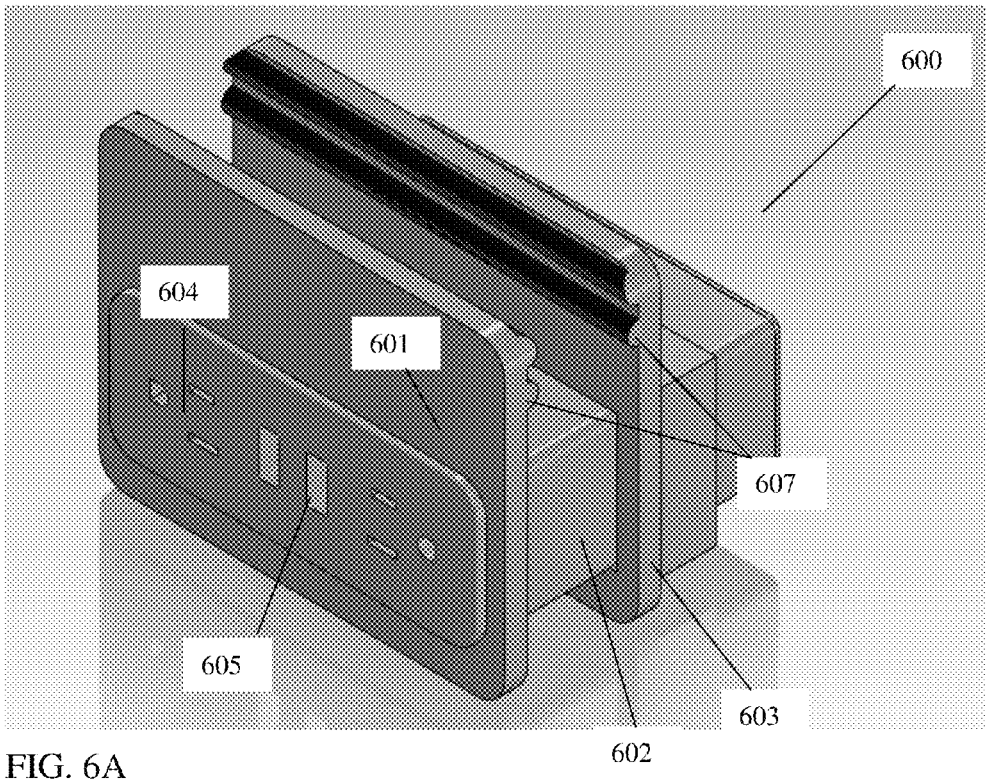
FIG. 6 shows a perspective view and FIG. 6A an underside view of another embodiment of the outlet extending system.
Figure 6A:
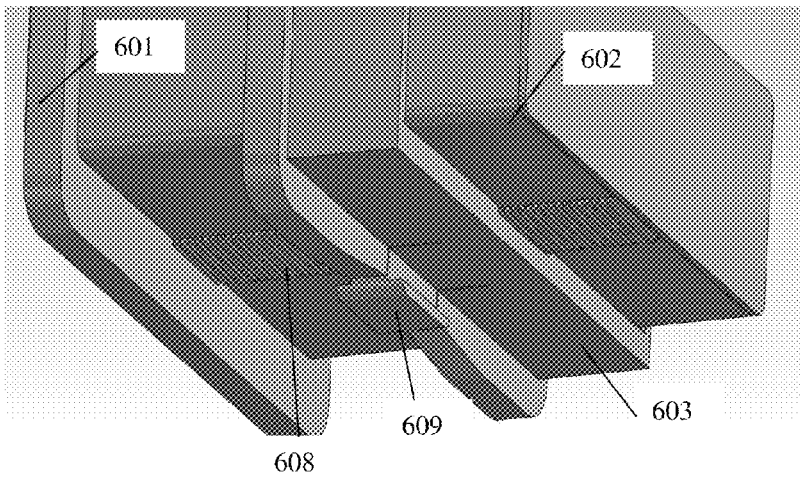

FIG. 6*a* shows another embodiment of the outlet extender 600 which has a face plate 601, connector 602 and sliding rear plate 603, with AC outlets 604 and USB outlets 605. In this embodiment, no rails for sliding the rear plate section 603 are needed. In addition, "ribs" 607 on the face plate 601 and rear plate 603 are shown to help grip any object the outlet extender 600 may be clamped onto. FIG. 6*b* shows an underside view of this embodiment, with serrations 608 and latch 609 which serve the purposes of serrations 506 and latch 508 in FIG. 5, namely providing a ratchet system to hold sliding rear plate 603 in place and a release latch 609 to allow it to slide for clamping purposes.

Figure 7:
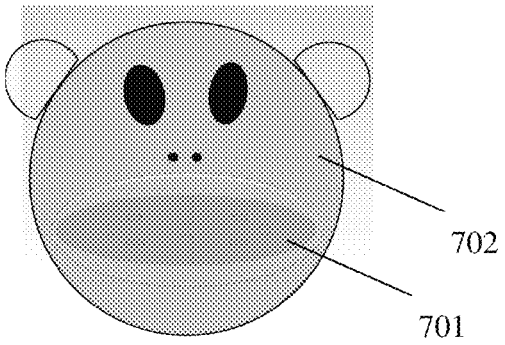
FIG. 7 and FIG. 7A show embodiments of detachable decorative faceplates for the outlet extending system.
Figure 7A:
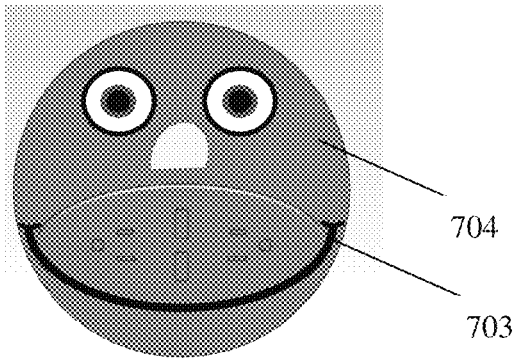

In a further embodiment of this invention, visible surfaces of said outlet extender could be of different colors or patterns, either to blend with the furniture to which it is attached or to stand out from it as a decor element or in order to easily find the outlets. Colors or patterns could also be used to match devices which may be plugged into the outlet extender. Removable or interchangeable covers for the visible surfaces of the outlet extender could be supplied to allow different combinations of these blending and contrasting functions. In a further embodiment of this invention, visible surfaces of said outlet extender could have textures or shapes chosen for their decorative characteristics. FIG. 7 shows examples of such decorative shapes and patterns, showing for example in FIG. 7*a* a "mouth" 701 of a face formed on the region of the outlets of the front plate 702 of an outlet extender as described herein, and in FIG. 7*b* a "smile" 703 formed by following the lower curve of the outlet region on a front plate 704. Clearly other features could be incorporated in this way, such as, by way of example, coaxial cable outlets for eyes. Many other interchangeable covers for the front plate 702/704 and for other parts of the outlet extender could be used having other colors, shapes and features. These designs may incorporate features of the outlets into their design, forming shapes such as, but not limited to, noses, lips, eyes, and so on. The plates may be formed in shapes such as a rectangle which might be used to portray a can, a football, a cartoon character and so on. These shapes, colors and patterns could be tailored to a variety of branding purposes for commercial brands of companies, people and products. These interchangeable covers could be removably attached by a variety of means including, but not limited to, Velcro, clips, snap-fit tabs, and magnets.

The outlet extender herein described could be fastened to a variety of relatively immobile pieces of furniture such as, but not limited to, couches, sideboards, bookcases, desks, beds, filing cabinets, tables, workbenches and entertainment units. Further, this outlet extender could be used to provide a temporary outlet in front of objects such as crates in warehouses and other relatively bulky, rarely moved items, or to provide a temporary outlet in any convenient place where an object may be onto which said outlet extender may be clamped, such as at a more convenient height then a wall or floor outlet may be situated.

In a further embodiment of this invention, rather than clamping the outlet housing to the front of a couch, it could be fastened perpendicularly to a plate which rests horizontally on the floor under a leg of the couch such that the couch holds the plate in place and the outlet housing faces outwards so that devices needing electrical current can be plugged into the outlet housing. In this way no clamp would be needed, the weight of the couch would hold the assembly in place.

In a further embodiment of this invention, multiple plugs and cords could be fed to a single outlet extender panel, such that, for example, both AC power and coaxial cable signal might be available at the outlet extender even though separate wall plugs may be used for each of these sources. Other combinations of signal are obviously possible with this system, including signals such as, but not limited to, analog, digital, and optical signal transmission methods. Similarly, a variety of AC and DC electrical power flows can be carried by this system.

It should be understood that the foregoing description is only illustrative of the embodiments. It should also be understood that the embodiments disclosed herein may be used individually or in any suitable combination thereof. Various alternatives and modifications can be devised by those skilled in the art without departing from the embodiments. Accordingly, the present embodiments are intended to embrace all such alternatives, modifications and variances.

What is claimed is:

1. A clamp-on outlet extender apparatus for passing some form of electrical current from at least one stationary source of electrical current to an accessible location on an object to which said outlet extender may be clamped, the extender apparatus comprising:

at least one first plug, capable of being electrically connected to said stationary source of electrical current;

at least one cord attached to said first plug, capable of conducting an electrical current to an outlet housing;

an outlet housing, providing some form of electrical current to at least one outlet being capable of receiving a second plug from an external device and thereby providing some form of electrical current to said external device;

said outlet housing having at least two plates, said plates each having at least one inner surface with a shape chosen from the group of flat, convex and concave, said inner surfaces facing each other and said outlet being present in at least one of said plates, said plates being capable of being moved towards or away from each other by using a ratchet type connecting system thereby forming a clamp system such that said outlet housing can be clamped to said object using said inner surfaces of said plates while exposing at least one of said outlets to receive said second plug on an outer surface of a plate.

2. An apparatus as defined in claim 1, wherein said clamp system additionally uses a spring type clamp system to apply clamping tension.

3. An apparatus as defined in claim 1, wherein said form of electrical current is chosen from the group comprising AC power and DC power.

4. An apparatus as defined in claim 1, wherein said stationary source of electrical current comprises a time varying signal transmitting data, said signal chosen from the group comprising analog and digital signals.

5. An apparatus as defined in claim 1, wherein at least two cords may carry electrical current from at least two different stationary sources.

6. An apparatus as defined in claim 1, wherein said outlet housing has visible decorative characteristics chosen from the group of colors, patterns, brands, textures and shapes, said decorative characteristics covering over 50% of the surface of the apparatus as visible from the direction from which said second plug would be plugged in.

7. An apparatus as defined in claim 6, wherein said outlet housing has provisions for interchangeable covers each having visible characteristics chosen from the group of colors, patterns, brands, textures and shapes, said interchangeable covers concealing over 50% of the surface of the apparatus as visible from the direction from which said second plug would be plugged in.

8. An apparatus as defined in claim 1, wherein said clamp system for said outlet housing is provided with padding on said inner surfaces.

9. An apparatus as defined in claim 1, wherein said outlet extender includes an electronic circuit which processes said stationary source of electrical current to carry out at least one operation chosen from the group comprising conversion from one type of electrical current supply to another type of electrical current supply and conditioning the electrical current from said stationary source in order to protect said external device.

10. An apparatus as defined in claim 9, wherein said conditioning comprises protection from electrical surges.

11. An apparatus as defined in claim 9, wherein said conversion comprises conversion of AC power into a USB type electrical output.

12. An apparatus as defined in claim 9, wherein both AC and USB power outlets are provided on said outlet housing.

13. An apparatus as defined in claim 9, wherein said electronic circuit is contained in said outlet housing.

14. An apparatus as defined in claim 1, wherein said outlet housing is designed to store said cord compactly by a means chosen from the group of retracting said cord into said outlet housing and wrapping said cord around said outlet housing.

15. A clamp-on outlet extender apparatus for passing some form of electrical current from at least one stationary source of electrical current to an accessible location on an object to which said outlet extender may be clamped, the extender apparatus comprising:

at least one first plug, capable of being electrically connected to said stationary source of electrical current;

at least one cord attached to said first plug, capable of conducting an electrical current to an outlet housing;

an outlet housing, providing some form of electrical current to at least one outlet being capable of receiving a second plug from an external device and thereby providing some form of electrical current to said external device;

said outlet housing having at least two plates, said plates each having at least one inner surface with a shape chosen from the group of flat, convex and concave, said inner surfaces facing each other and said outlet being present in at least one of said plates, said plates being capable of being moved towards or away from each other using a connecting system thereby forming a clamp system such that said outlet housing can be clamped to said object using said inner surfaces of said plates while exposing at least one of said outlets to receive said second plug on an outer surface of a plate, the total protrusion of the outer surface of the outlet containing plate beyond the surface of the accessible location of said object being no greater than 2 centimeters.

16. An apparatus as defined in claim 15, wherein said outlet extender includes an electronic circuit which processes said stationary source of electrical current to carry out at least one operation chosen from the group comprising conversion from one type of electrical current supply to another type of electrical current supply and conditioning the electrical current from said stationary source in order to protect said external device.

17. An apparatus as defined in claim 16, wherein said conditioning comprises protection from electrical surges.

18. An apparatus as defined in claim 16, wherein said conversion comprises conversion of AC power into a USB type electrical output, there being a USB power outlet being provided on said outer surface of said plate.

19. An apparatus as defined in claim 16, wherein said electronic circuit is contained in said outlet housing.

20. An apparatus as defined in claim 15, wherein said clamp system uses a screw type system to apply clamping tension.

21. An apparatus as defined in claim 15, wherein said clamp system for said outlet housing is provided with padding on said inner surfaces.

22. An apparatus as defined in claim 15, wherein said outlet housing has visible decorative characteristics chosen from the group of colors, patterns, brands, textures and shapes, said decorative characteristics covering over 50% of the surface of the apparatus as visible from the direction from which said second plug would be plugged in.

23. An apparatus as defined in claim 22, wherein said outlet housing has provisions for interchangeable covers each having visible characteristics chosen from the group of colors, patterns, brands, textures and shapes, said interchangeable covers concealing over 50% of the surface of the apparatus as visible from the direction from which said second plug would be plugged in.

* * * * *